US008944973B2

(12) United States Patent
Lalaoua

(10) Patent No.: US 8,944,973 B2
(45) Date of Patent: Feb. 3, 2015

(54) LOWER BODY EXERCISE

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 25 days.

(21) Appl. No.: 13/930,926

(22) Filed: Jun. 28, 2013

(65) Prior Publication Data

US 2014/0011647 A1 Jan. 9, 2014

Related U.S. Application Data

(60) Provisional application No. 61/690,515, filed on Jun. 28, 2012.

(51) Int. Cl.
*A63B 21/02* (2006.01)
*A63B 23/02* (2006.01)

(52) U.S. Cl.
CPC ..... *A63B 23/0211* (2013.01); *A63B 21/02* (2013.01)
USPC ..... 482/122; 482/121; 482/124; 482/71

(58) Field of Classification Search
USPC ..... 482/121–129, 51, 147, 907
See application file for complete search history.

(56) References Cited

U.S. PATENT DOCUMENTS

| | | | | |
|---|---|---|---|---|
| 5,279,532 | A * | 1/1994 | Chen | 482/71 |
| 6,368,254 | B1 * | 4/2002 | Wall | 482/71 |
| 7,303,511 | B2 * | 12/2007 | Bull | 482/71 |
| 7,438,673 | B1 * | 10/2008 | Jones | 482/71 |
| 7,556,592 | B2 * | 7/2009 | Nizam | 482/70 |
| D603,001 | S * | 10/2009 | Wong | D21/688 |
| D620,540 | S * | 7/2010 | McVay et al. | D21/668 |
| 7,780,585 | B1 * | 8/2010 | Rivas | 482/140 |
| 7,803,091 | B2 * | 9/2010 | Loane | 482/70 |
| 7,892,152 | B1 * | 2/2011 | Teng | 482/79 |
| 8,100,815 | B2 * | 1/2012 | Balaker et al. | 482/70 |

* cited by examiner

*Primary Examiner* — Stephen Crow
(74) *Attorney, Agent, or Firm* — Tianhua Gu; Global IP Services

(57) ABSTRACT

A lower body exerciser mainly comprises: a central base; two support brackets located at each side of the central base respectively; two slide tracks connecting the central base with each of the two support brackets respectively; two foot pedals mounted on each of the two slide tracks respectively; a connecting base being fixed under each foot pedal, matched with the slide track, and used for rotating around and sliding along the longitudinal direction of the arc-shaped slide track. A plurality of O-Ring elastic bands are mounted around the pulley sets to generate tension for exercise. The two slide tracks are hinged at each side of the central base respectively, so the exerciser is foldable for convenient carry and storage. This lower body exerciser could help to strengthen and define thighs, legs, buns and hips muscles with minimizing time and maximizing positive results.

17 Claims, 8 Drawing Sheets

LOWER BODY EXERCISE

CROSS REFERENCE TO RELATED PATENT APPLICATION

The present patent application claims the priority of U.S. 61/690,515 filed Jun. 28, 2012, which application is incorporated herein by reference.

FIELD OF INVENTION

The present invention relates to an exerciser, particularly to a lower body exerciser.

DESCRIPTION OF RELATED ART

As the pace of life getting faster and faster, more and more people are in sub-health state. Especially for those people who are long-term engaged in desk work. Because of long working hours, their lower bodies are lack of physical exercises and accompanied by feeling of fatigue difficult to be recovered. People need exercisers to train and build their bodies for health. Practically, many people are too busy to go to the gyms and they even hope to be working while performing exercises.

However, because of the complicated configuration, the conventional exercisers are heavy and bulky. It also increases the cost for storage and transportation. This kind of exerciser is not suitable to be used in a limit indoor space such as bedroom, living room or an office at any time. For some lower body exercisers with relative simple structures and appropriate sizes, the training positions and angles for exercise are lack of variations. Therefore, the conventional exercisers mainly perform stretching exercises to build lateral and internal leg muscles, the lower body could not get sufficient workout.

SUMMARY OF THE PRESENT INVENTION

It is therefore one object of the present invention to provide a lower body exerciser for solving the problems existing in the conventional exercisers and further to provide more different exercising methods in order to provide more options for exercise to get better workout.

The lower body exerciser mainly comprises: a central base; two support brackets located at each side of the central base respectively; two slide tracks connecting between the central base and each of the two support brackets respectively; two foot pedals mounted on each of the two slide tracks respectively; a connecting base matched with the slide track, fixed under each foot pedal and used for rotating around the slide track and sliding along the longitudinal direction of the arc-shaped slide track. A plurality of O-Ring elastic bands are mounted around the pulley sets disposed on the central base, the foot pedals and the support brackets to generate tension for exercise. The two slide tracks are hinged at each side of the central base respectively, so the exerciser is foldable and can stand in an upright position for fast and easy storage. Compared to the long training commitment products, this lower body exerciser helps strengthening and defining thighs, calves and hips muscles with minimizing time and maximizing positive results.

Effects of the Present Invention

1. Because the foot pedals could slidably and rotatably fit with the arc-shaped slide track, not only the lateral and internal leg muscles, but also the front and back muscles of buns, hips, thighs, calves are effectively trained while the user is moving the foot pedals.

2. The O-Ring elastic bands are utilized together with the pulley sets to generate tension for exercise. The user can increase or decrease tension by changing the O-Ring elastic bands from light, medium or harder tension to get different exercise workout.

3. The lower body exerciser has simple configuration, light weight to allow the user to utilize at a small space, and it could be folded and then stand in an upright position and is small enough for fast and easy storage.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
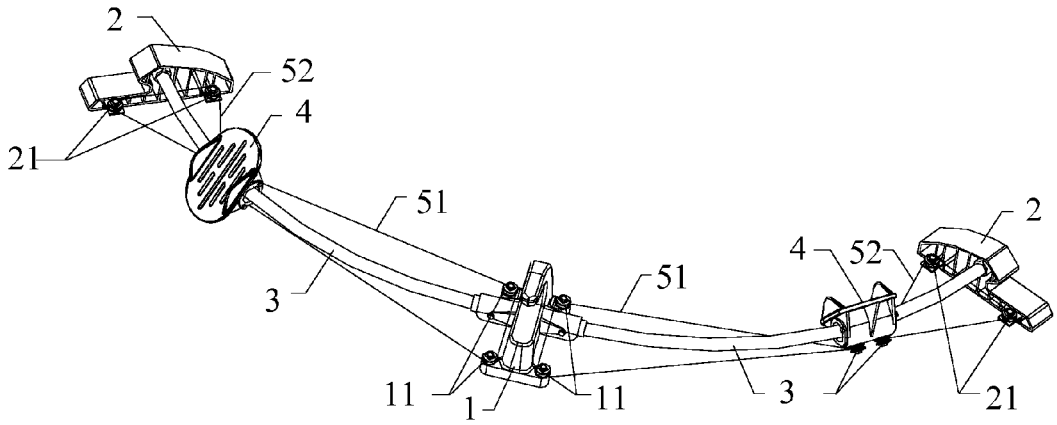
FIG. 1 shows a top view of the lower body exerciser in accordance with the present invention.
Figure 2:
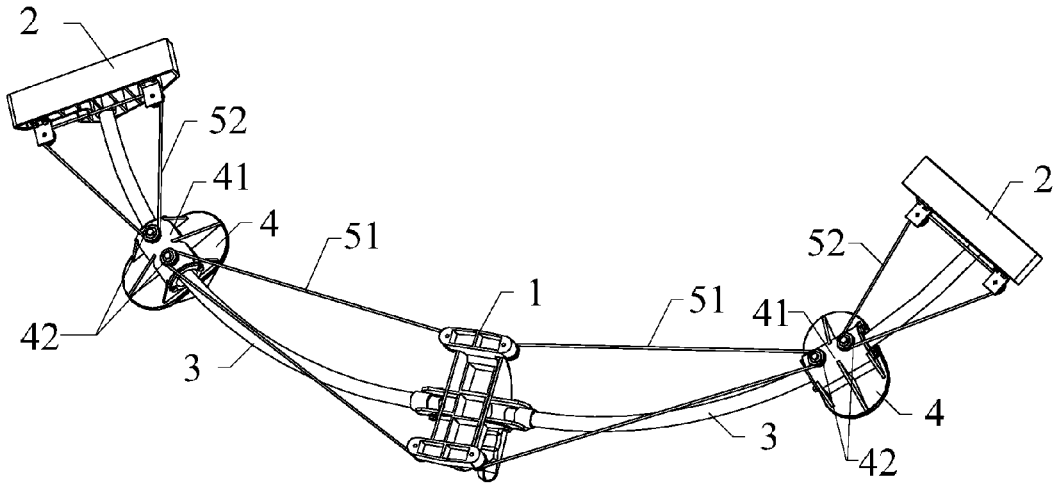
FIG. 2 shows a bottom view of the lower body exerciser in accordance with the present invention.
Figure 3:
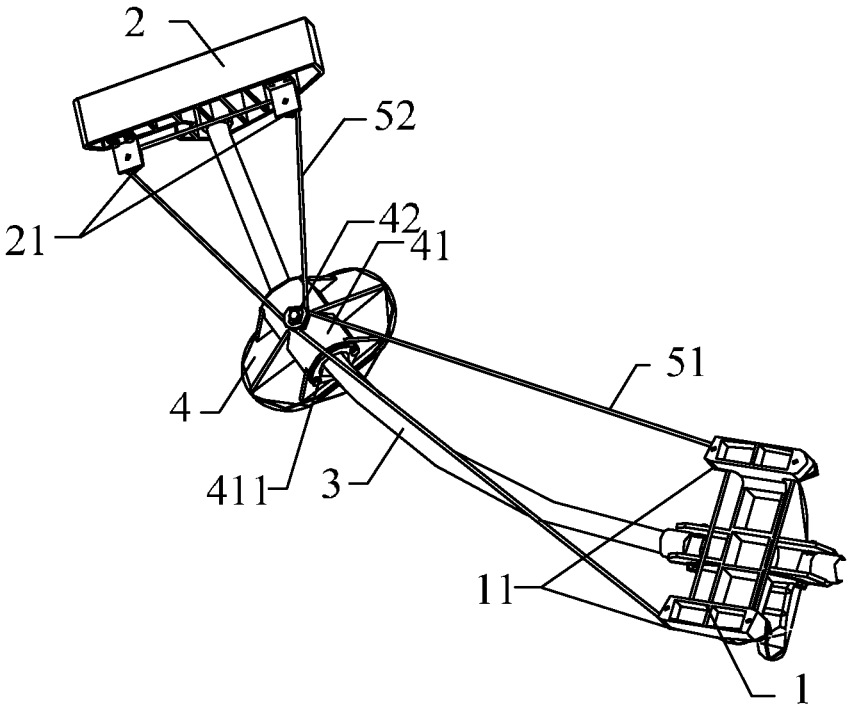
FIG. 3 shows a partial bottom view of the lower body exerciser in accordance with the present invention.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated herein.

The lower body exerciser is created with unique ergonomic design to naturally follow the inward or outward legs movements with the machine and more functions to tone and shape the lower body parts in order to achieve the best legs, hips and thighs workout. According to certain embodiment of the present disclosure, following figures could show the schematic structural views of the body exerciser provided by the invention.

Referring to FIG. 1 to FIG. 4, the body exerciser comprises a central base 1, two support brackets 2, two slide tracks3, two foot pedals 4. The central base 1 with a handle grip includes a left side and a right side. The two support brackets 2 locate at each side of the central base 1 respectively.

The two slide tracks 3 are connected with the central base 1 and each of the two support brackets 2 respectively. To allow the foot pedal 4 to slide smoothly, the slide track 3 could be circular tube or tubular rail made of metal material such as stainless steel or Aluminum or Titanium. The two foot pedals 4 are mounted on each of the two slide tracks 3 respectively. The foot pedal 4 is designed with ergonomic convex surfaces to match the foot contour. The connection between the foot pedal 4 and the slide track 3 is via a connecting base 41. The connecting base 41 is fixed under each foot pedal 4 and matches with the slide track 3. The connecting base 41 is used for rotating around the slide track 3 and sliding along the longitudinal direction of the slide track 3. The foot pedal 4 could be tilted upward or downward on the slide track 3.

A plurality of pulley sets are disposed on the body exerciser. A plurality of elastic bands are mounted around the pulley sets. The pulley sets and the elastic bands form a tension generation system. In some embodiments, a first pulley set 11 consists of four pulleys, wherein two pulleys are disposed on the left side of the central base 1, and the other two pulleys are disposed on the right side of it. Two second pulley sets 21 are respectively disposed on each of the two support brackets 2. The second pulley set 21 consists of two pulleys disposed at each end of the support bracket 2 respectively. A third pulley set 42 is disposed under the connecting base 41 or each of the foot pedals 4. The third pulley set 42 consists of one (as shown in the FIG. 3) or two pulleys (as shown in the FIG. 1 and FIG. 2). Each of two first elastic bands 51 is mounted around the first pulley set 11 and the third pulley set 42 at each side of the central base 1. Each of the two second elastic bands 52 is mounted around the second pulley set 21 and the third pulley set 42 at each side of the central base 1 respectively. Both the first elastic bands 51 and the second elastic bands 52 are O-Ring elastic bands.

Figure 4:
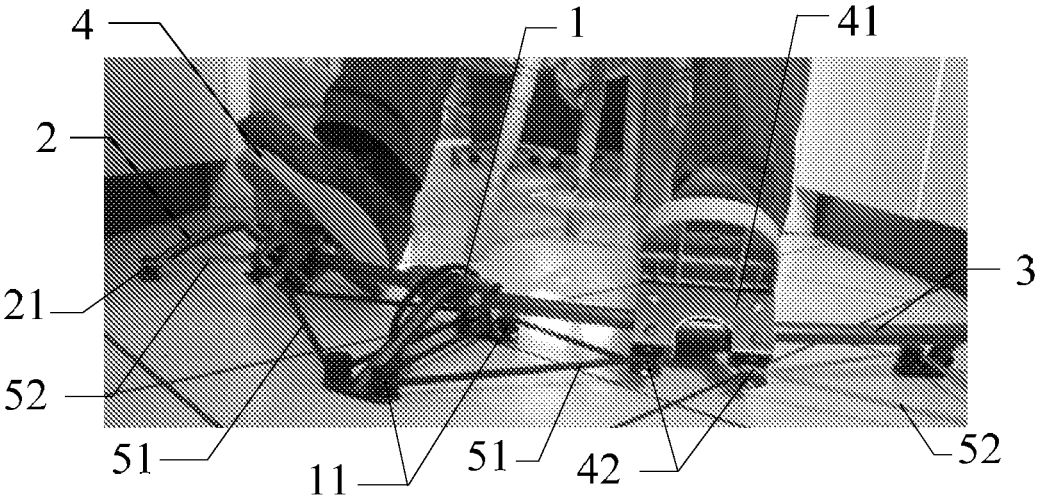
FIG. 4 shows a view of the lower body exerciser being in use in accordance with the present invention.

When in use, no matter indoor or outdoor, a user just needs to sit in a chair and step both feet on the two foot pedals 4. The user moves the foot pedals 4 with feet to slide along the longitudinal direction of the slide tracks 3 (as shown in FIG. 4). As feet moving toward the support brackets 2 (outward movement), the first elastic bands 51 will generate resistance to prevent the foot pedals 4 from moving. The foot pedals 4 are pulled by the first elastic bands 51, the second elastic bands 52 are released. Otherwise, as feet moving toward the central base 1 (inward movement), the foot pedals 4 are pulled by the second elastic bands 52, and the first elastic bands 51 are released. The third pulley set 42 is a pulley guide, which is designed to pull the O-Ring elastic bands in the inward or outward directions to create tension to the exercises. To move the foot pedals 4, the user has to exert force to overcome the resistance of O-Ring elastic bands. All pulleys of the first pulley sets, the second pulley sets and the third pulley sets are rotational, so that when the O-Ring elastic bands are pulled by the foot pedals pulley guide, all the pulleys will automatically turn to assist the stretching of the elastic bands for providing more smooth movements during the exercise. By repeating the inward and outward movements, buns, hips, thighs, calves are stretched and muscles are exercised, even the user is operating a computer, watching TV, writing a paper or doing anything else sitting in the chair.

The O-Ring elastic bands have three different resistance degrees. The user can increase or decrease tension by changing the O-Ring elastic bands from light, medium or harder tension just in seconds. The user can also connect one or two O-Ring elastic bands at the same time to provide tension in different directions.

The slide track 3 could be various shapes such as being straight (not shown in the figures) or arc. As conventional exercisers, the user horizontally moves the foot pedals 4 along the straight slide tracks 3, only the lateral and internal leg muscles are stretched. In some embodiments, the two slide tracks 3 are arc-shaped. The diameter of the arc is 160 cm. Therefore, when the user moves foot pedals 4 along the arc-shaped slide tracks 3, the buns, hips, thighs and calves muscles are worked to shape and tone at the same time. The arc-shaped slide tracks 3 also could be downwardly curved.

A counter device is disposed on the lower body exerciser to help the user counting times of repetitive actions. The counter device comprises a pair of sensors and an indicator. The sensors are mounted on the connections between the central base 1 and the slide tracks 3. One sensor is mounted on the left side of the central base 1, and the other one is mounted on the right side of the central base 1. The sensors are connected with the indicator fixed mounted on the top of the central base 1. Once the foot pedal touches the sensor, the indicator will show the times of accumulative actions.

The connecting base 41 comprises a through hole 411 configured to allow the slide track 3 to pass through. In order to work the hips, calves and buns, the user might choose the tilting positions to work the muscles in different angles. A plurality of sliding members are mounted in the through hole 411. The slide members are slidably and rotatably fitted with the slide track 3, so that the foot pedal 4 is allowed to travel along the longitudinal direction of the tubular slide tracks 3 and to tilt in multiple slopes and angle positions from down or up simultaneously (as shown in FIG. 1).

Figure 5A:
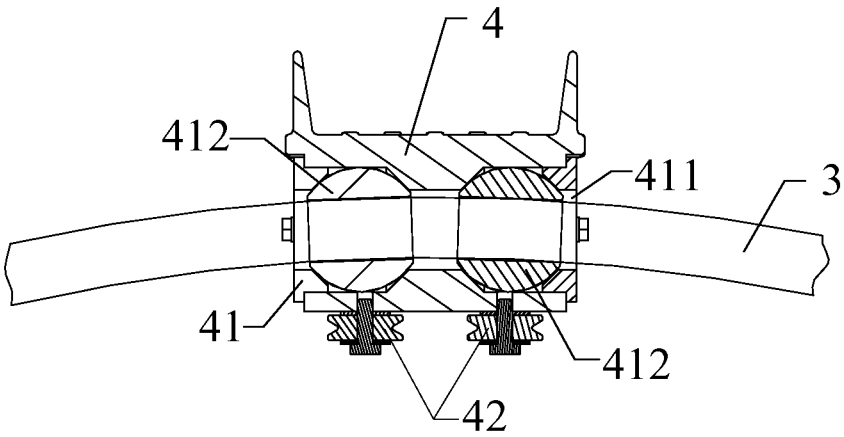
FIG. 5A shows a cross section view of an embodiment in accordance with the present invention.
Figure 5B:
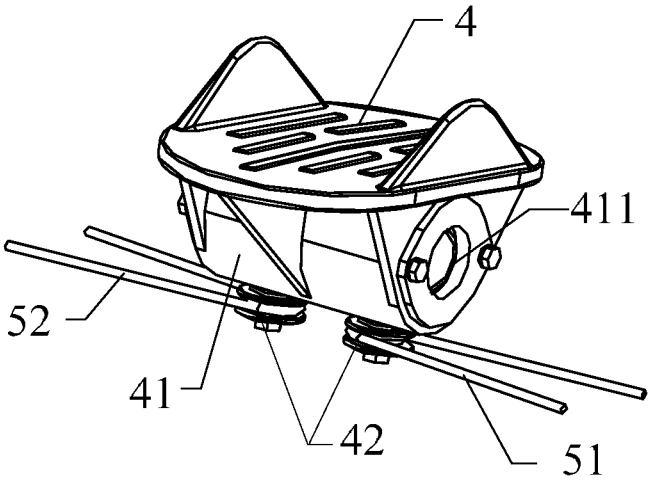
FIG. 5B shows a perspective view of the embodiment shown by the FIG. 5A.
Figure 6A:
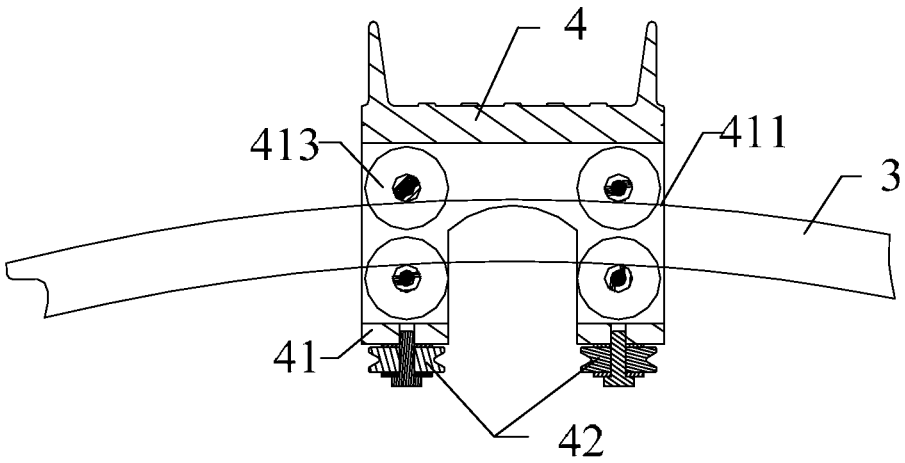
FIG. 6A shows a cross section view of another embodiment in accordance with the present invention.
Figure 6B:
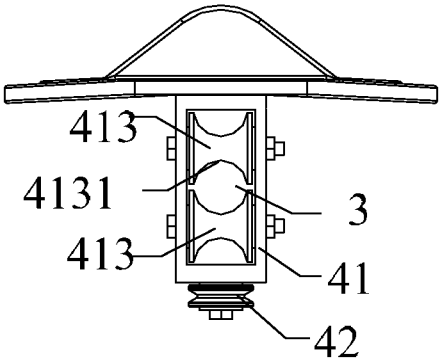
FIG. 6B shows a front view of the embodiment shown by the FIG. 6A.
Figure 6C:
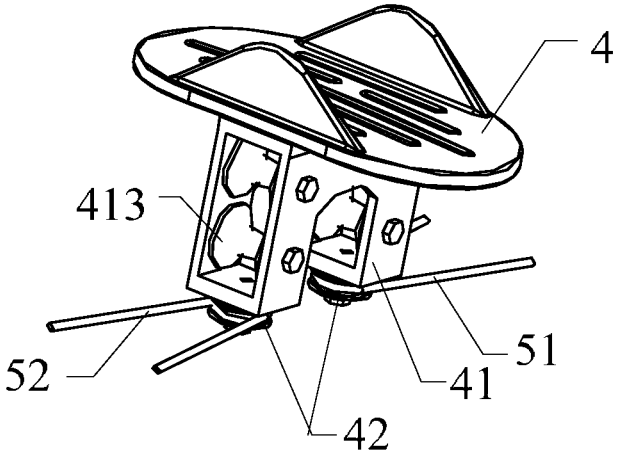
FIG. 6C shows a perspective view of the embodiment shown by the FIG. 6A.

Referring to FIG. 5A and FIG. 5B, in some embodiments, the sliding members are balls 412 with hollow holes fitted over each slide track 3. The balls 412 movably fit with the connecting base 41. The interior of the hallow holes of the balls 412 are in full contact with the surface of the slide track 3 and made to slide and move freely against the slide track 3. Two balls 412 are disposed inside the connecting base 41. The connecting base 41 relatively rotates around the balls 412, so that the foot pedal 4 could tilt with arbitrary angles. The balls 412 could be ball knobs made of nylon or high quality plastic for best sliding performance Referring to FIG. 6A~FIG. 6C, in some embodiments, the sliding members are trolley wheels 413. Since the slide track 3 is tubular, the trolley wheels 413 are rotatably mounted on each slide track 3. Four trolley wheels 413 equipped with recesses 4131 fitted with each slide track 3. Two of the wheels 413 are mounted on one side of the slide track 3, and the other two are mounted on the other side of the slide track 3. The balls 412 and the trolley wheels 413 follow the shape of the slide track 3 in a very smooth sliding movement without any noise.

Figure 7A:
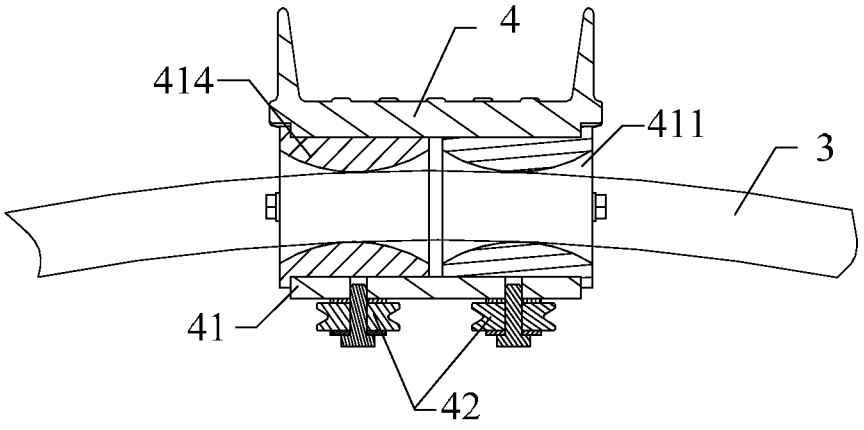
FIG. 7A shows a cross section view of another embodiment in accordance with the present invention.
Figure 7B:
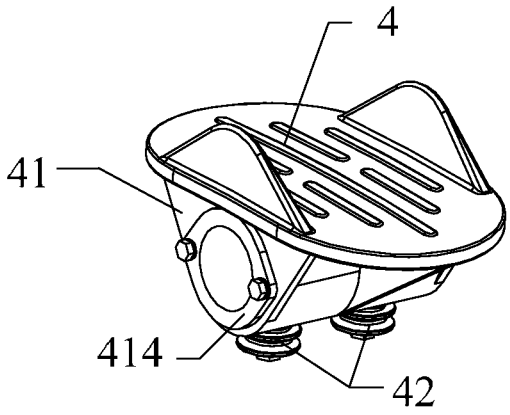
FIG. 7B shows a perspective view of the embodiment shown by the FIG. 7A.

Referring to FIG. 7A and FIG. 7B, in some embodiments, the sliding members are shaft housings 414 fixed connecting to the connecting base 41 at both sides of the through hole 411. The interior of each shaft housing 414 is made to be convex to suitable for the slide track 3, especially for the arc-shaped one. The connecting base 41 and the foot pedal 4 may be integrally molded as a whole. The shaft housings 414 are fixed with the connecting base 41 and the foot pedal 4.

Figure 8A:
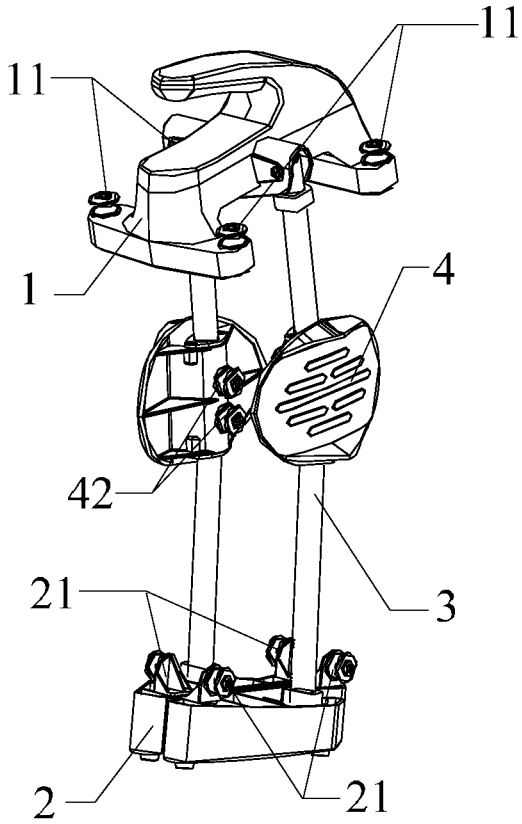
FIG. 8A shows a right perspective view of the lower body exerciser being folded in accordance with the present invention.
Figure 8B:
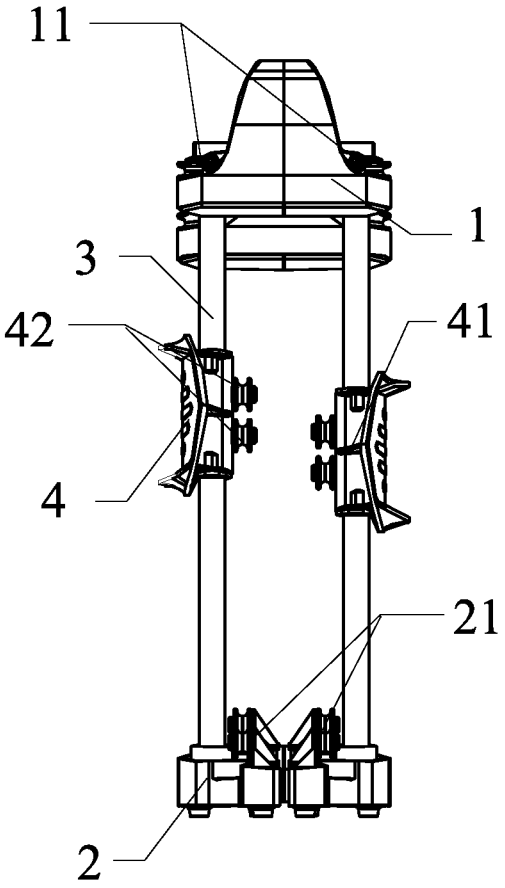
FIG. 8B shows a front view of the lower body exerciser being folded in accordance with the present invention.
Figure 8C:
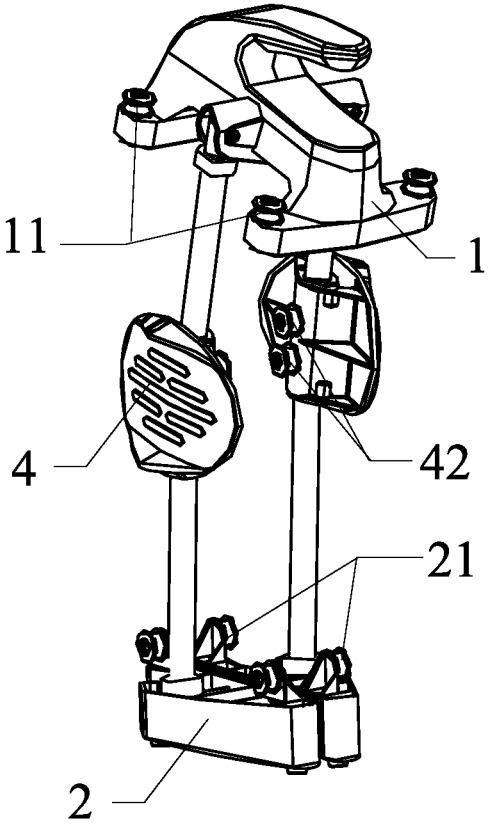
FIG. 8C shows a left perspective view of the lower body exerciser being folded in accordance with the present invention.
Figure 9:
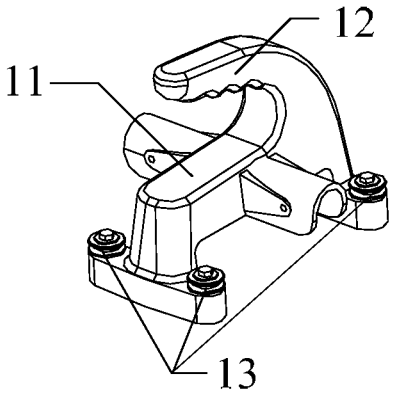
FIG. 9 shows a perspective view of the central base with a handle grip in accordance with the present invention.

Referring to FIG. 8A~FIG. 8C, in some embodiments, the two slide tracks 3 hinge at each side of the central base 1 respectively. One side of the slide track 3 is connected to the central base 1, and the other side is connected to the support bracket 2, so that the lower body exerciser could be folded. Referring to FIG. 9, an ergonomic handle grip 12 is disposed on the central base 1. The handle grip 12 has been designed with oval-shaped sectional contour for comfortable holding. After the exercise finished, the user could hold the handle grip 12 to lift up the lower body exerciser into an upright standing folded form to carry or store.

The lower body exerciser has light weight to allow the user to use at any indoor or outdoor situations such as at home, office, health clubs, fitness room, rehab center or physical therapy room. The exerciser is generally for people who want to get stronger and better looking thighs and legs in less time and can be used anywhere by any age. It only requests a small space to operate with a chair and is small and light enough for fast and easy storage.

Thus, the lower body exerciser has been described. Although the present disclosure has been described with reference to specific exemplary embodiments, it will be recognized that the disclosure is not limited to the embodiments described, but can be practiced with modification and alteration within the spirit and scope of the appended claims. Accordingly, the specification and drawings are to be regarded in an illustrative sense rather than a restrictive sense.

What is claimed is:

1. A lower body exerciser, comprising:

a central base with a first pulley set disposed at each side;

two support brackets located at each side of the central base respectively;

two slide tracks connecting between the central base and each of the two support brackets respectively;

two foot pedals mounted on each of the two slide tracks respectively, a connecting base being fixed under each the foot pedal, matched with the slide track and used for rotating around the slide track and sliding along the longitudinal direction of the slide track;

a second pulley set disposed at each of the two support brackets;

a third pulley set disposed under the connecting base or each foot pedal;

two first elastic bands respectively mounted around the first pulley set and the third pulley set at each side of the central base; and two second elastic bands respectively mounted around the second pulley set and the third pulley set at each side of the central base.

2. The lower body exerciser as recited in claim 1, wherein the two slide tracks are tubular ones.

3. The lower body exerciser as recited in claim 1, wherein the two slide tracks are straight ones.

4. The lower body exerciser as recited in claim 1, wherein the two slide tracks are arc-shaped ones.

5. The lower body exerciser as recited in claim 1, wherein the two slide tracks are downwardly curved.

6. The lower body exerciser as recited in claim 1, wherein the connecting base comprises a through hole configured to allow the slide track to pass through, a plurality of sliding members slidably fitted with the slide track and mounted in the through hole.

7. The lower body exerciser as recited in claim 6, wherein the sliding members are balls fitted over each the slide track and movably fitted with the connecting base.

8. The lower body exerciser as recited in claim 7, wherein the balls are ball knobs.

9. The lower body exerciser as recited in claim 6, wherein the sliding members are trolley wheels rotatably mounted on each the slide track, and the trolley wheels are equipped with recesses fitted with each the slide track.

10. The lower body exerciser as recited in claim 6, wherein the sliding members are shaft housings with convex interior, fixed connecting to the connecting base at both sides of the through hole.

11. The lower body exerciser as recited in claim 1, wherein the connecting base and the foot pedal are integrally molded as a whole.

12. The lower body exerciser as recited in claim 1, wherein the two slide tracks hinge at each side of the central base respectively.

13. The lower body exerciser as recited in claim 12, wherein a handle grip is disposed on the central base.

14. The lower body exerciser as recited in claim 1, wherein the number of pulleys of the third pulley sets is two.

15. The lower body exerciser as recited in claim 1, wherein the pulleys of the first pulley set, the second pulley set and the third pulley set are rotational.

16. The lower body exerciser as recited in claim 1, wherein the first elastic bands and the second elastic bands are O-Ring elastic bands.

17. The lower body exerciser as recited in claim 1, wherein a counter device is disposed on the lower body exerciser.

* * * * *